US009420652B2

(12) United States Patent
Yu et al.

(10) Patent No.: US 9,420,652 B2
(45) Date of Patent: Aug. 16, 2016

(54) LED DRIVER

(71) Applicant: Silergy Semiconductor Technology (Hangzhou) Ltd., Hangzhou (CN)

(72) Inventors: Feng Yu, Hangzhou (CN); Chen Zhao, Hangzhou (CN)

(73) Assignee: Silergy Semiconductor Technology (Hangzhou) Ltd., Hangzhou (CN)

( * ) Notice: Subject to any disclaimer, the term of this patent is extended or adjusted under 35 U.S.C. 154(b) by 0 days.

(21) Appl. No.: 14/496,294

(22) Filed: Sep. 25, 2014

(65) Prior Publication Data

US 2015/0091455 A1 Apr. 2, 2015

(30) Foreign Application Priority Data

Sep. 29, 2013 (CN) ..... 2013 1 0460841

(51) Int. Cl.
*G05F 1/00* (2006.01)
*H05B 33/08* (2006.01)

(52) U.S. Cl.
CPC ..... *H05B 33/0824* (2013.01)

(58) Field of Classification Search
CPC ..... H05B 37/02
USPC ..... 315/291, 307, 312, 185 R, 224
See application file for complete search history.

(56) References Cited

U.S. PATENT DOCUMENTS

| | | | | |
|---|---|---|---|---|
| 8,492,988 | B2 * | 7/2013 | Nuhfer et al. | 315/246 |
| 2011/0273102 | A1 * | 11/2011 | van de Ven | H05B 33/0809 315/193 |
| 2012/0133284 | A1 * | 5/2012 | Ge et al. | 315/121 |
| 2012/0235579 | A1 * | 9/2012 | Chemel et al. | 315/152 |
| 2012/0268013 | A1 * | 10/2012 | Riesebosch | 315/130 |
| 2013/0241423 | A1 * | 9/2013 | Chu | H05B 33/0824 315/191 |

FOREIGN PATENT DOCUMENTS

| | | | |
|---|---|---|---|
| CN | 101137261 | B | 3/2011 |
| CN | 102158082 | A | 8/2011 |
| CN | 102437744 | A | 5/2012 |
| CN | 102498449 | A | 6/2012 |
| CN | 102870501 | A | 1/2013 |
| CN | 103281823 | A | 9/2013 |

OTHER PUBLICATIONS

Office Action for Chinese Patent Application No. 201310460841.6, dated Dec. 1, 2014, 5 pages.
Third Office Action for Chinese Patent Application No. 201310460841.6, dated Dec. 10, 2015, 4 pages.

* cited by examiner

*Primary Examiner* — Minh D A
(74) *Attorney, Agent, or Firm* — Westman, Champlin & Koehler, P.A.

(57) ABSTRACT

A LED driver is disclosed herein. In one embodiment, the LED driver comprises a rectifier circuit, a driving current generating circuit, a bus voltage detection circuit, a LED configuration control circuit, and a LED array. The LED driver according to the present disclosure reconfigures the prior LED array, balances usage of each LED by switching operation of each LED, which results in long lifetime of the LED driver while reducing power dissipation or increasing a PF value.

10 Claims, 2 Drawing Sheets

LED DRIVER

CROSS-REFERENCE TO RELATED APPLICATION

This application claims the benefit of Chinese Patent Application No. 201310460841.6, filed on Sep. 29, 2013, which is incorporated herein by reference in its entirety.

TECHNICAL FIELD

The present disclosure relates to a driving circuit, and more specifically to a LED driver.

BACKGROUND

The power factor (PF) of an AC-DC LED driver should be limited within a certain range to meet harmonic standard. A conventional AC-DC LED driver may be of a single-stage type or of a two-stage type. The single-stage type of AC-DC LED driver may have a large PF value by providing suitable parameters. However, control variables are selected in a limited scope, and may not be suitable for optimizing efficiency of the LED driver. An electrolytic capacitor should be included as an essential part, which, however, reduces lifetime of the LED driver and causes flicker which can be observed by human eyes. The two-stage type of AC-DC LED driver may be controlled with control variables in a full range, has a high PF value, and is suitable for optimizing efficiency of the LED driver, without flicker which can be observed by human eyes. The LED driver has an input for receiving a pulsed power supply and an output for providing a flat power supply, and has a storage capacitor in an intermediate bus for balancing the power supplies. If the storage capacitor is an electrolytic capacitor, it will adversely influence lifetime of the LED driver. If the storage capacitor is a ceramic capacitor or a thin-film capacitor, its operation voltage range will limit an intermediate bus voltage, or its footprint will be large for providing a large voltage range. The capacitor will increase cost of the LED driver if having a large footprint.

An AC-DC LED driver using multiple bus voltages has been proposed, which uses no electrolytic capacitor by means of power discretion control, and hence increases lifetime of the LED driver and has no problem of flicker. A control scheme for multiple-stage sequential LED strings configuration has been proposed by Seoul Semiconductor Co. Ltd., in which the LED strings are basically configured as shown in FIG. 1. The control scheme has a beneficial effect of avoiding flicker, but has an adverse effect of non-uniform usage of LEDs. For example, LED La maintains an on state when switch Sa is closed; LEDs La and Lb maintain an on state when switch Sb is closed; LEDs La, Lb and Lc maintain an on state when switches Sa and Sb are both opened. LED La has usage higher than that of LEDs Lb and Lc, which adversely influences lifetime of the whole system. Thus, the usage of LEDs is low or non-uniform in an inappropriate design of LED configuration scheme, which results in reduced lifetime of the whole system.

RELATED APPLICATIONS

One object of the present disclosure is to provide an LED driver which balances usage of LEDs to increase lifetime of the LED driver while reducing power dissipation or increasing PF value.

According to one aspect of the present disclosure, there is provided a LED driver comprising a rectifier circuit, a driving current generating circuit, a bus voltage detection circuit, a LED configuration control circuit, and a LED array, wherein the rectifier circuit has an input for receiving an AC voltage and an output for providing a DC output voltage which is obtained by rectifying the AC voltage;

the driving current generating circuit has an input for receiving the DC voltage and an output for providing a driving current to the LED array for its operation;

the bus voltage detection circuit detects a bus voltage in the driving current generating circuit and has an output for providing a value of the bus voltage;

the LED configuration control circuit controls on and off states of LEDs in the LED array in accordance with the value of the bus voltage; and the LED array comprises a plurality of LEDs connected in series with each other and one or more switches each connected in parallel with at least one of the plurality of LEDs, and the LED configuration control circuit controls on and off states of the switches.

According to another aspect of the present disclosure, there is provided a driving method using the above LED driver, comprising:

step 1, a rectifier circuit receives an AC voltage at an input, rectifies the AC voltage, and provides a DC voltage at an output to a driving current generating circuit;

step 2, the driving current generating circuit converts the DC voltage into a driving current for driving the LED array;

step 3, a bus voltage detection circuit detects a bus voltage in the driving current generating circuit and provides the bus voltage to a LED configuration control circuit;

step 4, the LED configuration control circuit controls on and off states of LEDs in a LED array in accordance with the value of the bus voltage; and step 5, the driving current generating circuit adjusts the driving current output therefrom in accordance with a number of the LEDs in an on state so as to reduce power dissipation or increase power factor of the LED driver.

Preferably, the driving current generating circuit divides the bus voltage into a plurality of levels, and divides the driving current into a plurality of corresponding levels.

Preferably, the driving current generating circuit outputs the driving current which is adjusted in accordance with an actual operation state of each LED in the LED array, when the bus voltage detection circuit detects that the level of the bus voltage decreases gradually, a number of the LEDs connected in series in an on state decreases gradually and the driving current increases so that the LED driver has a constant output power, or the driving current decreases so that the LED driver has a high power factor;

when the bus voltage detection circuit detects that the level of the bus voltage increases gradually, the number of the LEDs connected in series in an on state increases gradually and the driving current decreases so that the LED driver has a constant output power, or the driving current increases so that the LED driver has a high power factor.

Preferably, the driving current output from the driving current generating circuit is adjusted in accordance with an actual operation state of each LED in the LED array, in a case that the output power of the LED driver is constant, when the bus voltage detection circuit detects that the bus voltage has a first voltage value, the number of the LEDs connected in series in an on state has a minimum value, and the driving current, which has a maximum value below a rated current of the LEDs, is adjusted to be a first current value;

when the bus voltage detection circuit detects that the bus voltage has a second voltage value, the number of the LEDs connected in series in an on state has a value between the minimum value and a maximum value, and the driving current is adjusted to be a second current value;

when the bus voltage detection circuit detects that the bus voltage has a third voltage value, the number of the LEDs connected in series in an on state has the maximum value, and the driving current is adjusted to be a third current value.

Preferably, the driving current generating circuit outputs the driving current which is adjusted in accordance with an actual operation state of each LED in the LED array, in a case that the LED driver has a high power factor, when the bus voltage detection circuit detects that the bus voltage has a first voltage value, the number of the LEDs connected in series in an on state has a minimum value, and the driving current is adjusted to be a third current value;

when the bus voltage detection circuit detects that the bus voltage has a second voltage value, the number of the LEDs connected in series in an on state has a value between the minimum value and a maximum value, and the driving current is adjusted to be a second current value;

when the bus voltage detection circuit detects that the bus voltage has a third voltage value, the number of the LEDs connected in series in an on state has the maximum value, and the driving current, which has a maximum value below a rated current of the LEDs, is adjusted to be a first current value.

Preferably, the LED array comprises a plurality of switches and a plurality of LEDs which are connected to each other, and wherein the plurality of LEDs are connected in series between a high output voltage terminal and a low output voltage terminal of the driving current generating circuit, and the plurality of switches are each connected in parallel with one or more of the plurality of LEDs.

Preferably, the LED array comprises two LEDs and two switches, the two LEDs comprises a first LED and a second LED, a cathode of the first LED is connected to an anode of the second LED, and an anode of the first LED and a cathode of the second LED are connected to the high voltage output terminal and the low voltage output terminal, respectively;

the two switches comprise a first switch and a second switch, the first switch is connected in parallel with the first LED, and the second switch is connected in parallel with the second LED.

Preferably, the first voltage value is the minimum voltage level, and the third voltage value is the maximum voltage level, and the first current value is the maximum current value, and the third current value is the minimum current value which is one half of the first current value, in a case that the output power of the LED driver is constant, when the bus voltage reaches the first voltage value, the LED configuration control circuit turns off the first switch or the second switch, and the driving current generating circuit adjusts the driving current to be the first current value;

when the bus voltage reaches the third voltage value, the LED configuration control circuit turns off the first switch and the second switch, and the driving current generating circuit adjusts the driving current to be the third current value;

in a case that the LED driver has a high power factor, when the bus voltage reaches the first voltage value, the LED configuration control circuit turns off the first switch or the second switch, and the driving current generating circuit adjusts the driving current to be the third current value; and when the bus voltage reaches the third voltage value, the LED configuration control circuit turns off the first switch and the second switch, and the driving current generating circuit adjusts the driving current to be the first current value.

Preferably, the LED array comprises three LEDs and two switches, the three LEDs comprises a third LED, a fourth LED and a fifth LED, a cathode of the third LED is connected to an anode of the fourth LED, a cathode of the fourth LED is connected to an anode of the fifth LED, and an anode of the third LED and a cathode of the fifth LED are connected to the high voltage output terminal and the low voltage output terminal, respectively;

the two switches comprise a third switch and a fourth switch, the third switch is connected in parallel with the third LED, and the fourth switch is connected in parallel with the fourth LED and the fifth LED which are connected in series with each other;

or, the third switch is connected in parallel with the fifth LED, and the fourth switch is connected in parallel with the third LED and the fourth LED which are connected in series with each other.

Preferably, the first voltage value is the minimum voltage level, the third voltage value is the maximum voltage level, and the second voltage value is a value between the minimum voltage level and the maximum voltage level, and the first current value is the maximum current value, the second current value is a value between the minimum current value and the maximum current value and is one half of the first current value, and the third current value is the minimum value and is one third of the first current value, in a case that the output power of the LED driver is constant, when the bus voltage reaches the first voltage value, the LED configuration control circuit turns off the third switch and turns on the fourth switch, and the driving current generating circuit adjusts the driving current to be the first current value;

when the bus voltage reaches the second voltage value, the LED configuration control circuit turns on the third switch and turns off the fourth switch, and the driving current generating circuit adjusts the driving current to be the second current value;

when the bus voltage reaches the third voltage value, the LED configuration control circuit turns off the third switch and the fourth switch, and the driving current generating circuit adjusts the driving current to be the third current value;

in a case that the LED driver has a high power factor, when the bus voltage reaches the first voltage value, the LED configuration control circuit turns off the third switch and turns on the fourth switch, and the driving current generating circuit adjusts the driving current to be the third current value;

when the bus voltage reaches the second voltage value, the LED configuration control circuit turns on the third switch and turns off the fourth switch, and the driving current generating circuit adjusts the driving current to be the second current value;

when the bus voltage reaches the third voltage value, the LED configuration control circuit turns off the third switch and the fourth switch, and the driving current generating circuit adjusts the driving current to be the first current value;

Preferably, the LED array comprises three LEDs and four switches, the three LEDs comprises a sixth LED, a seventh LED and an eighth LED, a cathode of the sixth LED is connected to an anode of the seventh LED, a cathode of the seventh LED is connected to an anode of the eighth LED, and an anode of the sixth LED and a cathode of the eighth LED are connected to the high voltage output terminal and the low voltage output terminal, respectively;

the four switches comprise a fifth switch, a sixth switch, a seventh switch and an eighth switch, the fifth switch is connected in parallel with the sixth LED, the seventh switch is connected in parallel with the eighth LED, the sixth switch is connected in parallel with the seventh LED and the eighth LED which are connected in series with each other, and the eighth switch is connected in parallel with the sixth LED and the seventh LED which are connected in series with each other.

Preferably, the LED array has a first operation mode and a second operation mode. In the first operation mode, the seventh switch and the eighth switch both maintain an off state. The first voltage value is the minimum voltage level, the third voltage value is the maximum voltage level, and the second voltage value is a value between the minimum voltage level and the maximum voltage level, and the first current value is the maximum current value, the second current value is a value between the minimum current value and the maximum current value and is one half of the first current value, and the third current value is the minimum value and is one third of the first current value, in a case that the output power of the LED driver is constant, when the bus voltage reaches the first voltage value, the LED configuration control circuit turns off the fifth switch and turns on the sixth switch, and the driving current generating circuit adjusts the driving current to be the first current value;

when the bus voltage reaches the second voltage value, the LED configuration control circuit turns on the fifth switch and turns off the sixth switch, and the driving current generating circuit adjusts the driving current to be the second current value;

when the bus voltage reaches the third voltage value, the LED configuration control circuit turns off the fifth switch and the sixth switch, and the driving current generating circuit adjusts the driving current to be the third current value;

in a case that the LED driver has a high power factor, when the bus voltage reaches the first voltage value, the LED configuration control circuit turns off the fifth switch and turns on the sixth switch, and the driving current generating circuit adjusts the driving current to be the third current value;

when the bus voltage reaches the second voltage value, the LED configuration control circuit turns on the fifth switch and turns off the sixth switch, and the driving current generating circuit adjusts the driving current to be the second current value;

when the bus voltage reaches the third voltage value, the LED configuration control circuit turns off the fifth switch and the sixth switch, and the driving current generating circuit adjusts the driving current to be the first current value;

In the second operation mode, the fifth switch and the sixth switch both maintain an off state. The first voltage value is the minimum voltage level, the third voltage value is the maximum voltage level, and the second voltage value is a value between the minimum voltage level and the maximum voltage level, and the first current value is the maximum current value, the second current value is a value between the minimum current value and the maximum current value and is one half of the first current value, and the third current value is the minimum value and is one third of the first current value, in a case that the output power of the LED driver is constant, when the bus voltage reaches the first voltage value, the LED configuration control circuit turns off the seventh switch and turns on the eighth switch, and the driving current generating circuit adjusts the driving current to be the third current value;

when the bus voltage reaches the second voltage value, the LED configuration control circuit turns on the seventh switch and turns off the eighth switch, and the driving current generating circuit adjusts the driving current to be the second current value;

when the bus voltage reaches the third voltage value, the LED configuration control circuit turns off the seventh switch and the eighth switch, and the driving current generating circuit adjusts the driving current to be the first current value;

in a case that the LED driver has a high power factor, when the bus voltage reaches the first voltage value, the LED configuration control circuit turns off the seventh switch and turns on the eighth switch, and the driving current generating circuit adjusts the driving current to be the first current value;

when the bus voltage reaches the second voltage value, the LED configuration control circuit turns on the seventh switch and turns off the eighth switch, and the driving current generating circuit adjusts the driving current to be the second current value;

when the bus voltage reaches the third voltage value, the LED configuration control circuit turns off the seventh switch and the eighth switch, and the driving current generating circuit adjusts the driving current to be the third current value.

The present disclosure can advantageously provide the following beneficial effects over the prior art:

The LED driver according to the present disclosure reconfigures the prior LED array, balances usage of each LED by switching operation of each switch, which results in long lifetime of the LED driver while reducing power dissipation or increasing a PF value.

BRIEF DESCRIPTION OF THE DRAWINGS

The disclosure will be further illustrated in conjunction with the accompanying drawings.

In FIGS. 1 to 7,

La, Lb, Lc, Lm1, Lm2, . . . , Lmn: LED;

Sa, Sb, Sm1, Sm2, . . . , Sm(n−1), Sm1', Sm2°, . . . , Sm(n−1)': switches;

L1: the first LED; L2: the second LED; L3: the third LED; L4: the fourth LED;

L5: the fifth LED; L6: the sixth LED; L7: the seventh LED; L8: the eighth LED;

S1: the first switch; S2: the second switch; S3: the third switch; S4: the fourth switch;

S5: the fifth switch; S6: the sixth switch; S7: the seventh switch; S8: the eighth switch;

$V_{in}$: AC voltage; $V_g$: DC voltage; $V_o$: output voltage; $i_L$: driving current.

DESCRIPTION OF EMBODIMENTS

Reference may now be made in detail to particular embodiments of the LED driver according to the present disclosure, examples of which are illustrated in the accompanying drawings. Other advantages and features of the present disclosure will become readily apparent from claims and the detailed description of preferred embodiments below. The accompanying drawings are illustrative and not intended to be limiting, but are examples of embodiments of the disclosure, are simplified for explanatory purposes, and are not drawn to scale.

The inventive idea of the present disclosure is to provide a LED driver comprising a rectifier circuit, a driving current generating circuit, a bus voltage detection circuit, a LED configuration control circuit, and a LED array, wherein the rectifier circuit has an input for receiving an AC voltage and an output for providing a DC output voltage which is obtained by rectifying the AC voltage; the driving current generating circuit has an input for receiving the DC voltage and an output for providing a driving current to the LED array for its operation; the bus voltage detection circuit detects a bus voltage in the driving current generating circuit and has an output for providing a value of the bus voltage; the LED configuration control circuit controls on and off states of LEDs in the LED array in accordance with the value of the bus voltage; and the LED array comprises a plurality of LEDs connected in series with each other and one or more switches each connected in parallel with at least one of the plurality of LEDs, and the LED configuration control circuit controls on and off states of the switches. The LED driver according to the present disclosure reconfigures the prior LED array, balances usage of each LED by switching operation of each switch, which results in long lifetime of the LED driver while reducing power dissipation or increasing a PF value.

Figure 1:
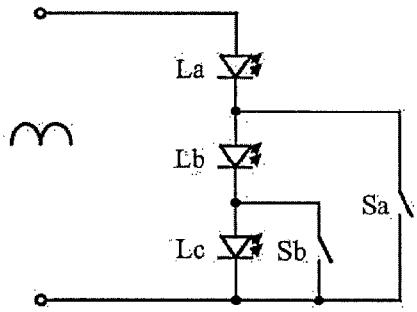
FIG. 1 is a schematic diagram showing a basic configuration of a LED string according to the prior art.
Figure 2:
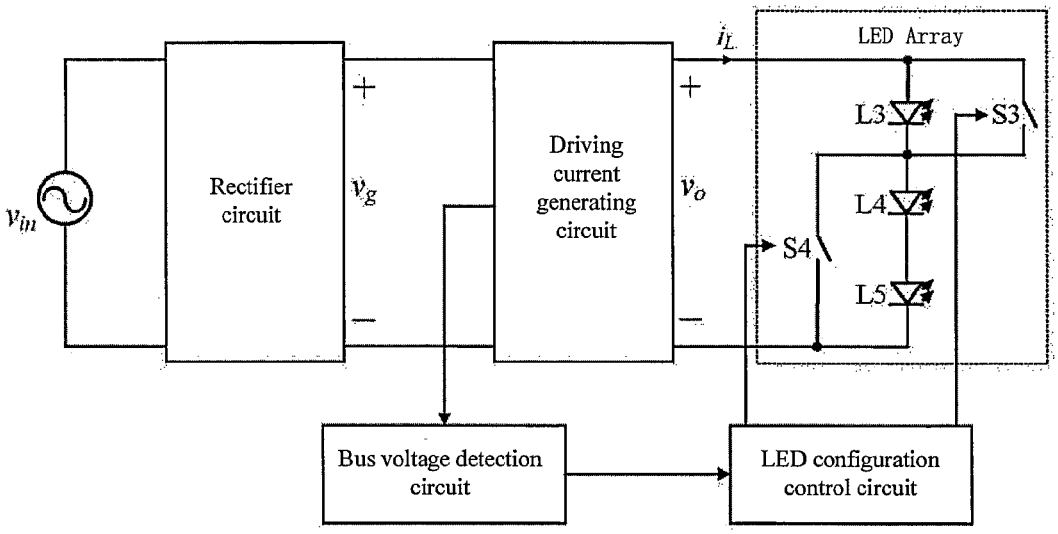
FIG. 2 is a schematic diagram showing an example LED driver according to one embodiment of the present disclosure.
Figure 3:
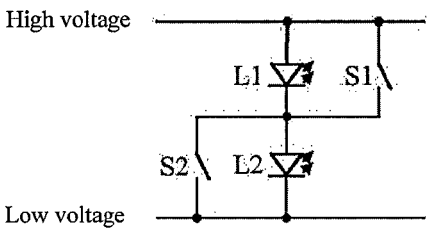
FIG. 3 is a schematic diagram showing an example LED array according to the first embodiment of the present disclosure.
Figure 4:
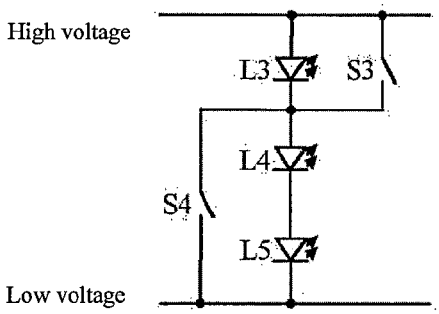
FIG. 4 is a schematic diagram showing an example LED array according to the second embodiment of the present disclosure.
Figure 5:
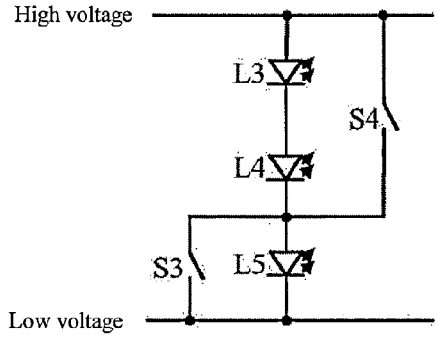
FIG. 5 is a schematic diagram showing another example LED array according to the second embodiment of the present disclosure.
Figure 6:
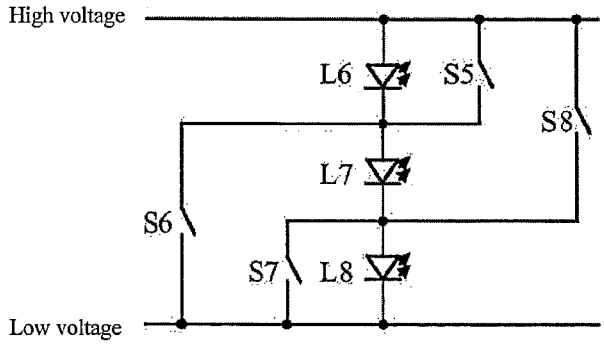
FIG. 6 is a schematic diagram showing an example LED array according to the third embodiment of the present disclosure.
Figure 7:
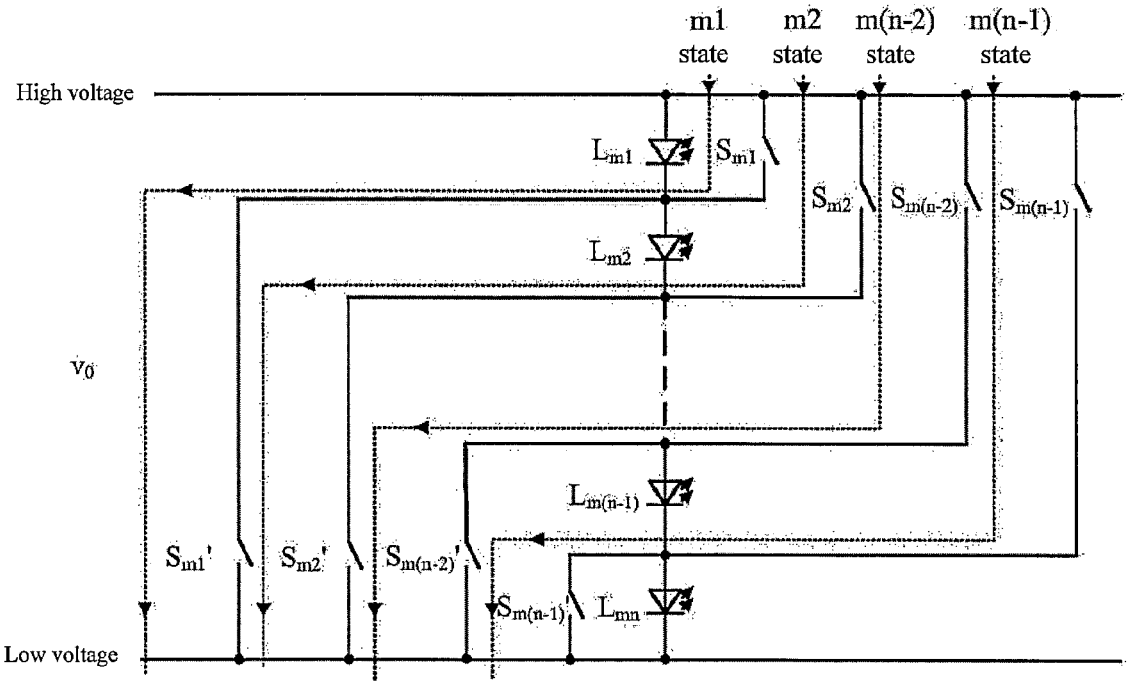
FIG. 7 is a schematic diagram showing an example LED array according to the fourth embodiment of the present disclosure.

Embodiments of the present disclosure will be described with reference to FIGS. 2 to 6, in which FIG. 2 is a schematic diagram showing an example LED driver according to one embodiment of the present disclosure; FIG. 3 is a schematic diagram showing an example LED array according to the first embodiment of the present disclosure; FIG. 4 is a schematic diagram showing an example LED array according to the second embodiment of the present disclosure; FIG. 5 is a schematic diagram showing another example LED array according to the second embodiment of the present disclosure; FIG. 6 is a schematic diagram showing an example LED array according to the third embodiment of the present disclosure; and FIG. 7 is a schematic diagram showing an example LED array according to the fourth embodiment of the present disclosure.

Referring to FIG. 2, one embodiment of the present disclosure is a LED driver comprising a rectifier circuit, a driving current generating circuit, a bus voltage detection circuit, a LED configuration control circuit, and a LED array, wherein the rectifier circuit has an input for receiving an AC voltage and an output for providing a DC output voltage which is obtained by rectifying the AC voltage;

the driving current generating circuit has an input for receiving the DC voltage and an output for providing a driving current to the LED array for its operation;

the bus voltage detection circuit detects a bus voltage in the driving current generating circuit and has an output for providing a value of the bus voltage;

the LED configuration control circuit controls on and off states of LEDs in the LED array in accordance with the value of the bus voltage; and the LED array comprises a plurality of LEDs connected in series with each other and one or more switches each connected in parallel with at least one of the plurality of LEDs, and the LED configuration control circuit controls on and off states of the switches.

Another one embodiment of the present disclosure is a driving method using the above LED driver comprising:

step 1, a rectifier circuit receives an AC voltage at an input, rectifies the AC voltage, and provides a DC voltage at an output to a driving current generating circuit step 2, the driving current generating circuit converts the DC voltage into a driving current for driving the LED array;

step 3, a bus voltage detection circuit detects a bus voltage in the driving current generating circuit and provides the bus voltage to a LED configuration control circuit;

step 4, the LED configuration control circuit controls on and off states of LEDs in a LED array in accordance with the value of the bus voltage; and step 5, the driving current generating circuit adjusts the driving current output therefrom in accordance with a number of the LEDs in an on state so as to reduce power dissipation or increase power factor of the LED driver.

Preferably, the driving current generating circuit divides the bus voltage into a plurality of levels, and divides the driving current into a plurality of corresponding levels.

Preferably, the driving current generating circuit outputs the driving current which is adjusted in accordance with an actual operation state of each LED in the LED array, when the bus voltage detection circuit detects that the level of the bus voltage decreases gradually, a number of the LEDs connected in series in an on state decreases gradually and the driving current increases so that the LED driver has a constant output power, or the driving current decreases so that the LED driver has a high power factor;

when the bus voltage detection circuit detects that the level of the bus voltage increases gradually, the number of the LEDs connected in series in an on state increases gradually and the driving current decreases so that the LED driver has a constant output power, or the driving current increases so that the LED driver has a high power factor.

Preferably, the driving current outputted from the driving current generating circuit is adjusted in accordance with an actual operation state of each LED in the LED array, in a case that the output power of the LED driver is constant, when the bus voltage detection circuit detects that the bus voltage has a first voltage value, the number of the LEDs connected in series in an on state has a minimum value, and the driving current, which has a maximum value below a rated current of the LEDs, is adjusted to be a first current value;

when the bus voltage detection circuit detects that the bus voltage has a second voltage value, the number of the LEDs connected in series in an on state has a value between the minimum value and a maximum value, and the driving current is adjusted to be a second current value;

when the bus voltage detection circuit detects that the bus voltage has a third voltage value, the number of the LEDs connected in series in an on state has the maximum value, and the driving current is adjusted to be a third current value.

Preferably, the driving current generating circuit outputs the driving current which is adjusted in accordance with an actual operation state of each LED in the LED array, in a case that the LED driver has a high power factor, when the bus voltage detection circuit detects that the bus voltage has a first voltage value, the number of the LEDs connected in series in an on state has a minimum value, and the driving current is adjusted to be a third current value;

when the bus voltage detection circuit detects that the bus voltage has a second voltage value, the number of the LEDs connected in series in an on state has a value between the minimum value and a maximum value, and the driving current is adjusted to be a second current value;

when the bus voltage detection circuit detects that the bus voltage has a third voltage value, the number of the LEDs connected in series in an on state has the maximum value, and the driving current is adjusted to be a first current value.

Preferably, the LED array comprises a plurality of switches and a plurality of LEDs which are connected to each other, and wherein the plurality of LEDs are connected in series between a high output voltage terminal and a low output voltage terminal of the driving current generating circuit, and the plurality of switches are each connected in parallel with one or more of the plurality of LEDs.

Embodiment One

In the present embodiment, the LED array comprises two LEDs L1 and L2, and two switches S1 and S2, as shown in FIG. 3. The two LEDs comprise a first LED L1 and a second LED L2. A cathode of the first LED L1 is connected to an anode of the second LED L2. Moreover, an anode of the first LED L1 and a cathode of the second LED L2 are connected to the high voltage output terminal and the low voltage output terminal of an output voltage $V_o$, respectively. The two switches comprise a first switch S1 and a second switch S2. The first switch S1 and the second switch S2 are connected in parallel with the first LED L1 and the second LED L2 respectively. The LED configuration control circuit is used for controlling on and off states of the two switches S1 and S2.

In the present embodiment, the first voltage value is the minimum voltage level, and the third voltage value is the maximum voltage level, and the first current value is the maximum current value, and the third current value is the minimum current value which is one half of the first current value.

Moreover, in step 4, the LED configuration control circuit turns off the first switch S1 or the second switch S2 when the bus voltage reaches the first voltage value, and turns off both of the first switch S1 and the second switch S2 when the bus voltage reaches the third voltage value.

In the present embodiment, the first switch S1 and the second switch S2 may be turned off alternatively each time when the bus voltage reaches the first voltage value, so that the usage of the LEDs is balanced.

Moreover, in step 5, it is assumed in one case that the output power of the LED driver is constant.

When the bus voltage reaches the first voltage value, only one of the first LED L1 and the second LED L2 is turned on, and $V_o$ is equal to $V_L$, which is a voltage drop across the first LED L1 or the second LED L2. The driving current generating circuit adjusts the driving current $i_L$ to be $I_L$ which is the first current value. Hence, the output power $P_o$ is $P_L$. When the bus voltage reaches the third voltage value, both of the first LED L1 and the second LED L2 are turned on, and $V_o$ is equal to $2V_L$. The driving current generating circuit adjusts the driving current $i_L$ to be $I_L/2$, which is the second current value. Hence, the output power $P_o$ is still $P_L$. The output voltage of the present circuit is constant and the power dissipation is minimized.

It is assuming in another case that the LED driver has a high power factor.

When the bus voltage reaches the first voltage value, only one of the first LED L1 and the second LED L2 is turned on, and $V_o$ is equal to $V_L$, which is a voltage drop across the first LED L1 or the second LED L2. The driving current generating circuit adjusts the driving current $i_L$ to be $I_L/2$ which is the second current value. Hence, the output power $P_o$ is $P_L/2$. When the bus voltage reaches the second voltage value, both of the first LED L1 and the second LED L2 are turned on, and $V_o$ is equal to $2V_L$. The driving current generating circuit adjusts the driving current $i_L$ to be $I_L$, which is the first current value. Hence, the output power $P_o$ is 2PL. The present circuit has an increased voltage level and thus a high PF value.

Embodiment Two

As compared with the first embodiment, the LED array and steps 4 and 5 of the driving method according to the second embodiment are different. Other technical features are the same as or substantially similar to those of the first embodiment and will not be described in detail.

In the present embodiment, the LED array comprises three LEDs L3, L4 and L5, and two switches S3 and S4, as shown in FIGS. 4 and 5. The three LEDs comprise a third LED L3, a fourth LED L4 and a fifth LED L5. A cathode of the third LED L3 is connected to an anode of the fourth LED L4. A cathode of the fourth LED L4 is connected to an anode of the fifth LED L5. Moreover, an anode of the third LED L3 and a cathode of the fifth LED L5 are connected to the high voltage output terminal and the low voltage output terminal of an output voltage $V_o$, respectively. The two switches comprise a third switch S3 and a fourth switch S4. The third switch S3 is connected in parallel with the third LED L3 or the fifth LED L5. The fourth switch S4 is connected in parallel with other two of the LEDs L3 to L5. The LED configuration control circuit is used for controlling on and off states of the two switches S3 and S4.

In the present embodiment, the first voltage value is the minimum voltage level, the third voltage value is the maximum voltage level, and the second voltage value is a value between the minimum voltage level and the maximum voltage level, and the first current value is the maximum current value, the second current value is a value between the minimum current value and the maximum current value which is one half of the first current value, and the third current value is the minimum value which is one third of the first current value.

Moreover, in step 4, the LED configuration control circuit turns off the third switch S3 when the bus voltage reaches the first voltage value, turns on the third switch S3 and turns off the fourth switch S4 when the bus voltage reaches the second voltage value, and turns off both of the third switch S3 and the fourth switch S4 when the bus voltage reaches the third voltage value.

Moreover, in step 5, it is assumed in one case that the output power of the LED driver is constant.

When the bus voltage reaches the first voltage value, only one of the third LED L3 and the fifth LED L5 is turned on, and $V_o$ is equal to $V_L$, which is a voltage drop across the third LED L3 or the fifth LED L5. The driving current generating circuit adjusts the driving current $i_L$ to be $I_L$ which is the first current value. Hence, the output power $P_o$ is $P_L$. When the bus voltage reaches the second voltage value, the fourth LED L4 and the fifth LED L5 are turned on, or the third LED L3 and the fourth LED L4 are turned on, and $V_o$ is equal to $2V_L$. The driving current generating circuit adjusts the driving current $i_L$ to be $I_L/2$, which is the second current value. Hence, the output power $P_o$ is still $P_L$. When the bus voltage reaches the third voltage value, all of the third LED L3, the fourth LED L4 and the fifth LED L5 are turned on, and $V_o$ is equal to $3V_L$. The driving current generating circuit adjusts the driving current $i_L$ to be $I_L/3$, which is the third current value. Hence, the output power $P_o$ is still $P_L$. The output voltage of the present circuit is constant and the power dissipation is minimized.

It is assuming in another case that the LED driver has a high power factor.

When the bus voltage reaches the first voltage value, only one of the third LED L3 and the fifth LED L5 is turned on, and $V_o$ is equal to $V_L$, which is a voltage drop across the third LED L3 or the fifth LED L5. The driving current generating circuit adjusts the driving current $i_L$ to be $I_L/3$ which is the third current value. Hence, the output power $P_o$ is $P_L/3$. When the bus voltage reaches the second voltage value, the fourth LED L4 and the fifth LED L5 are turned on, or the third LED L3 and the fourth LED L4 are turned on, and $V_o$ is equal to $2V_L$. The driving current generating circuit adjusts the driving current $i_L$ to be $I_L/2$, which is the second current value. Hence, the output power $P_o$ is $P_L$. When the bus voltage reaches the third voltage value, all of the third LED L3, the fourth LED L4 and the fifth LED L5 are turned on, and $V_o$ is equal to $3V_L$. The driving current generating circuit adjusts the driving current $i_L$ to be $I_L$, which is the first current value. Hence, the output power $P_o$ is 3PL. The present circuit has an increased voltage level and thus a high PF value.

Embodiment Three

As compared with the above two embodiments, the LED array and steps 4 and 5 of the driving method according to the third embodiment are different. Other technical features are the same as or substantially similar to those of the above two embodiments and will not be described in detail.

In the present embodiment, the LED array comprises three LEDs L6, L7 and L8, and four switches S5, S6, S7 and S8, as shown in FIG. 6. The three LEDs comprise the sixth LED L6, the seventh LED L7 and the eighth LED L8. A cathode of the sixth LED L6 is connected to an anode of the seventh LED L7. A cathode of the seventh LED L7 is connected to an anode of the eighth LED L8. Moreover, an anode of the sixth LED L6 and a cathode of the eighth LED L8 are connected to the high voltage output terminal and the low voltage output terminal of an output voltage $V_o$, respectively. The four switches comprise the fifth switch S5, the sixth switch S6, the seventh switch S7 and the eighth switch S8. The fifth switch S5 is connected in parallel with the sixth LED L6. The seventh switch S7 is connected in parallel with the eighth LED L8. The sixth switch S6 is connected in parallel with the seventh LED L7 and the eighth LED L8. The eighth switch S8 is connected in parallel with the sixth LED L6 and the seventh LED L7. The LED configuration control circuit controls on and off states of the four switches S5, S6, S7 and S8.

In the present embodiment, the first voltage value is the minimum voltage level, the third voltage value is the maximum voltage level, and the second voltage value is a value between the minimum voltage level and the maximum voltage level, and the first current value is the maximum current value, the second current value is a value between the minimum current value and the maximum current value which is one half of the first current value, and the third current value is the minimum value which is one third of the first current value.

Moreover, the LED configuration control circuit has two switching control modes in step 4. The two switching control modes can be changed from one to the other, instead of being performed simultaneously, so as to avoid flicker.

In the first switching control mode, the seventh switch S7 and the eighth switch S8 maintain an off state. The LED configuration control circuit turns off the fifth switch S5 when the bus voltage reaches the first voltage value, turns on the fifth switch S5 and turns off the sixth switch S6 when the bus voltage reaches the second voltage value, and turns off both of the fifth switch S5 and the sixth switch S6 when the bus voltage reaches the third voltage value.

In the second switching control mode, the fifth switch S5 and the sixth switch S6 maintain an off state. The LED configuration control circuit turns off the seventh switch S7 when the bus voltage reaches the first voltage value, turns on the seventh switch S7 and turns off the eighth switch S8 when the bus voltage reaches the second voltage value, and turns off both of the seventh switch S7 and the eighth switch S8 when the bus voltage reaches the third voltage value.

In the present embodiment, the two switching control modes may be performed alternatively so as to balance the usage of the LEDs.

Moreover, in step 5, it is assumed in one case that the output power of the LED driver is constant.

When the bus voltage reaches the first voltage value, only one of the sixth LED L6 and the eighth LED L8 is turned on, and $V_o$ is equal to $V_L$, which is a voltage drop across the sixth LED L6 or the eighth LED L8. The driving current generating circuit adjusts the driving current $i_L$ to be $I_L$ which is the first current value. Hence, the output power $P_o$ is $P_L$. When the bus voltage reaches the second voltage value, the seventh LED L7 and the eighth LED L8 are turned on, or the sixth LED L6 and the seventh LED L7 are turned on, and $V_o$ is equal to $2V_L$. The driving current generating circuit adjusts the driving current $i_L$ to be $I_L/2$, which is the second current value. Hence, the output power $P_o$ is still $P_L$. When the bus voltage reaches the third voltage value, all of the sixth LED L6, the seventh LED L7 and the eighth LED L8 are turned on, and $V_o$ is equal to $3V_L$. The driving current generating circuit adjusts the driving current $i_L$ to be $I_L/3$, which is the third current value. Hence, the output power $P_o$ is still $P_L$. The output voltage of the present circuit is constant and the power dissipation is minimized.

It is assuming in another case that the LED driver has a high power factor.

When the bus voltage reaches the first voltage value, only one of the sixth LED L6 and the eighth LED L8 is turned on, and $V_o$ is equal to $V_L$, which is a voltage drop across the sixth LED L6 or the eighth LED L8. The driving current generating circuit adjusts the driving current $i_L$ to be $I_L/3$ which is the third current value. Hence, the output power $P_o$ is $P_L/3$. When the bus voltage reaches the second voltage value, the seventh LED L7 and the eighth LED L8 are turned on, or the sixth LED L6 and the seventh LED L7 are turned on, and $V_o$ is equal to $2V_L$. The driving current generating circuit adjusts the driving current $i_L$ to be $I_L/2$, which is the second current value. Hence, the output power $P_o$ is $P_L$. When the bus voltage reaches the third voltage value, all of the sixth LED L6, the seventh LED L7 and the eighth LED L8 are turned on, and $V_o$ is equal to $3V_L$. The driving current generating circuit adjusts the driving current $i_L$ to be $I_L$, which is the first current value. Hence, the output power $P_o$ is 3PL. The present circuit has an increased voltage level and thus a high PF value.

Embodiment Four

The present embodiment is an extension of the LED array according the third embodiment. As shown in FIG. 7, LEDs Lm1, Lm2, . . . , Lmn are connected in series between a high output voltage terminal and a low output voltage terminal of an output voltage $V_o$. Switches Sm1, Sm2, . . . , Sm(n−1) each have one end connected to the high output voltage terminal of the output voltage $V_o$, and the other end connected to a cathode of the respective one of the LEDs Lm1, Lm2, . . . , Lm(n−1). Switches Sm1', Sm2', . . . , Sm(n−1)' each have one end connected to the low output voltage terminal of the output voltage $V_o$, and the other end connected to an anode of the respective one of the LEDs Lm2, . . . , Lmn. The LED configuration control circuit has a plurality of switching control modes. The plurality of switching control modes, including the states m1, m2, . . . , and state m(n−1), can be changed from one to another, instead of being performed simultaneously.

The above configuration extension can control on and off states and usage of the LEDs as required. Each time when the bus voltage increased to a higher level, one more LED is turned on and the driving current is adjusted, so that the LED driver has a constant output power or a high power factor. The LED driver has an increased lifetime by balancing usage of the LEDs, while reducing power dissipation or increase PF value.

Apparently, one skilled person may introduce various modifications and alternatives into the present disclosure, without departing from the spirit and scope of the disclosure. The disclosure is intended to cover all of alternatives, modifications and equivalents that may be included within the spirit and scope of the disclosure as defined by the appended claims.

What is claimed is:

1. A LED driver comprising a rectifier circuit, a driving current generating circuit, a bus voltage detection circuit, a LED configuration control circuit, and a LED array, wherein said rectifier circuit has an input for receiving an AC voltage and an output for providing a DC output voltage which is obtained by rectifying said AC voltage;

said driving current generating circuit has an input for receiving said DC voltage and an output for providing a driving current to said LED array;

said bus voltage detection circuit detects a bus voltage in said driving current generating circuit and has an output for providing a value of said bus voltage;

said LED configuration control circuit controls on and off states of LEDs in said LED array in accordance with said value of said bus voltage; and said LED array comprises a plurality of LEDs connected in series with each other and one or more switches each connected in parallel with at least one of said plurality of LEDs, and said LED configuration control circuit controls on and off states of said switches, wherein said driving current generating circuit outputs said driving current which is adjusted in accordance with an actual operation state of each LED in said LED array, said driving current generating circuit divides said bus voltage into a plurality of voltage levels, and divides said driving current into a plurality of current levels, when said bus voltage detection circuit detects that said level of said bus voltage decreases gradually, the number of said LEDs connected in series in an on state decreases gradually, and said driving current increases to corresponding one of said plurality of current levels;

when said bus voltage detection circuit detects that said level of said bus voltage increases gradually, said number of said LEDs connected in series in an on state increases gradually, and said driving current decreases to corresponding one of said plurality of current levels.

2. The LED driver according to claim 1, wherein when said bus voltage detection circuit detects that said bus voltage has a first voltage value, said number of said LEDs connected in series in an on state has a minimum value, and said driving current is adjusted to be a first current value;

when said bus voltage detection circuit detects that said bus voltage has a second voltage value, said number of said LEDs connected in series in an on state has a value between said minimum value and a maximum value, and said driving current is adjusted to be a second current value;

when said bus voltage detection circuit detects that said bus voltage has a third voltage value, said number of said LEDs connected in series in an on state has said maximum value, and said driving current is adjusted to be a third current value.

3. The LED driver according to claim 2, wherein said LED array comprises said plurality of switches and said plurality of LEDs which are connected to each other, and wherein said plurality of LEDs are connected in series between a high output voltage terminal and a low output voltage terminal of said driving current generating circuit, and said plurality of switches are each connected in parallel with one or more of said plurality of LEDs.

4. The LED driver according to claim 3, wherein said LED array comprises two LEDs and two switches, said two LEDs comprises a first LED and a second LED, a cathode of said first LED is connected to an anode of said second LED, and an anode of said first LED and a cathode of said second LED are connected to said high voltage output terminal and said low voltage output terminal, respectively;

said two switches comprise a first switch and a second switch, said first switch is connected in parallel with said first LED, and said second switch is connected in parallel with said second LED.

5. The LED driver according to claim 4, wherein said first voltage value is a minimum voltage value, and said third voltage value is a maximum voltage value, and said first current value is a maximum current value below a rated current of said LEDs, and said third current value is a minimum current value which is one half of said first current value, when said bus voltage reaches said first voltage value, said LED configuration control circuit turns off said first switch or said second switch, and said driving current generating circuit adjusts said driving current to be said first current value;

when said bus voltage reaches said third voltage value, said LED configuration control circuit turns off said first switch and said second switch, and said driving current generating circuit adjusts said driving current to be said third current value.

6. The LED driver according to claim 3, wherein said LED array comprises three LEDs and two switches, said three LEDs comprises a third LED, a fourth LED and a fifth LED, a cathode of said third LED is connected to an anode of said fourth LED, a cathode of said fourth LED is connected to an anode of said fifth LED, and an anode of said third LED and a cathode of said fifth LED are connected to said high voltage output terminal and said low voltage output terminal, respectively;

said two switches comprise a third switch and a fourth switch, said third switch is connected in parallel with said third LED, and said fourth switch is connected in parallel with said fourth LED and said fifth LED which are connected in series with each other; or said third switch is connected in parallel with said fifth LED, and said fourth switch is connected in parallel with said third LED and said fourth LED which are connected in series with each other.

7. The LED driver according to claim 6, wherein said first voltage value is a minimum voltage value, said third voltage value is a maximum voltage value, and said second voltage value is a value between said minimum voltage value and said maximum voltage value, and said first current value is a maximum current value below a rated current of said LEDs, said second current value is a value between a minimum current value and said maximum current value and is one half of said first current value, and said third current value is said minimum current value and is one third of said first current value, when said bus voltage reaches said first voltage value, said LED configuration control circuit turns off said third switch and turns on said fourth switch, and said driving current generating circuit adjusts said driving current to be said first current value;

when said bus voltage reaches said second voltage value, said LED configuration control circuit turns on said third switch and turns off said fourth switch, and said driving current generating circuit adjusts said driving current to be said second current value;

when said bus voltage reaches said third voltage value, said LED configuration control circuit turns off said third switch and said fourth switch, and said driving current generating circuit adjusts said driving current to be said third current value.

8. The LED driver according to claim 3, wherein said LED array comprises three LEDs and four switches, said three LEDs comprises a sixth LED, a seventh LED and an eighth LED, a cathode of said sixth LED is connected to an anode of said seventh LED, a cathode of said seventh LED is connected to an anode of said eighth LED, and an anode of said sixth LED and a cathode of said eighth LED are connected to said high voltage output terminal and said low voltage output terminal, respectively;

said four switches comprise a fifth switch, a sixth switch, a seventh switch and an eighth switch, said fifth switch is connected in parallel with said sixth LED, said seventh switch is connected in parallel with said eighth LED, said sixth switch is connected in parallel with said seventh LED and said eighth LED which are connected in series with each other, and said eighth switch is connected in parallel with said sixth LED and said seventh LED which are connected in series with each other.

9. The LED driver according to claim 8, wherein said seventh switch and said eighth switch maintain an off state, said first voltage value is a minimum voltage value, said third voltage value is a maximum voltage value, and said second voltage value is a value between said minimum voltage value and said maximum voltage value, and said first current value is a maximum current value below a rated current of said LEDs, said second current value is a value between a minimum current value and said maximum current value and is one half of said first current value, and said third current value is said minimum current value and is one third of said first current value, when said bus voltage reaches said first voltage value, said LED configuration control circuit turns off said fifth switch and turns on said sixth switch, and said driving current generating circuit adjusts said driving current to be said first current value;

when said bus voltage reaches said second voltage value, said LED configuration control circuit turns on said fifth switch and turns off said sixth switch, and said driving current generating circuit adjusts said driving current to be said second current value;

when said bus voltage reaches said third voltage value, said LED configuration control circuit turns off said fifth switch and said sixth switch, and said driving current generating circuit adjusts said driving current to be said third current value.

10. The LED driver according to claim 8, wherein said fifth switch and said sixth switch maintain an off state, said first voltage value is a minimum voltage value, said third voltage value is a maximum voltage value, and said second voltage value is a value between said minimum voltage value and said maximum voltage value, and said first current value is said maximum current value, said second current value is a value between a minimum current value and said maximum current value and is one half of said first current value, and said third current value is said minimum current value and is one third of said first current value, when said bus voltage reaches said first voltage value, said LED configuration control circuit turns off said seventh switch and turns on said eighth switch, and said driving current generating circuit adjusts said driving current to be said third current value;

when said bus voltage reaches said second voltage value, said LED configuration control circuit turns on said seventh switch and turns off said eighth switch, and said driving current generating circuit adjusts said driving current to be said second current value;

when said bus voltage reaches said third voltage value, said LED configuration control circuit turns off said seventh switch and said eighth switch, and said driving current generating circuit adjusts said driving current to be said first current value.

* * * * *